US008307767B2

(12) United States Patent
Skinner et al.

(10) Patent No.: US 8,307,767 B2
(45) Date of Patent: Nov. 13, 2012

(54) IMPACT INITIATED VENTING SYSTEM AND METHOD OF USING SAME

(75) Inventors: Anthony T. Skinner, Duncanville, TX (US); Michael L. Fortner, Bedford, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 2080 days.

(21) Appl. No.: 11/120,295

(22) Filed: May 2, 2005

(65) Prior Publication Data

US 2006/0243153 A1 Nov. 2, 2006

(51) Int. Cl.
*F42C 15/00* (2006.01)

(52) U.S. Cl. ..... 102/481; 102/275.11

(58) Field of Classification Search ..... 102/275.11, 102/380, 381, 481; 89/36.17
See application file for complete search history.

(56) References Cited

U.S. PATENT DOCUMENTS

| | | | | | |
|---|---|---|---|---|---|
| 3,853,058 | A * | 12/1974 | Tartault et al. | ..... | 102/374 |
| 3,960,085 | A * | 6/1976 | Abernathy et al. | ..... | 102/492 |
| 5,402,720 | A * | 4/1995 | Bottorff et al. | ..... | 102/378 |
| 5,466,537 | A * | 11/1995 | Diede et al. | ..... | 428/548 |
| 5,824,941 | A * | 10/1998 | Knapper | ..... | 89/36.17 |
| 6,382,105 | B1 * | 5/2002 | Jones | ..... | 102/370 |

* cited by examiner

*Primary Examiner* — David Parsley
(74) *Attorney, Agent, or Firm* — Slater & Matsil, L.L.P.

(57) ABSTRACT

An initiator includes a detonation port and a reactive panel coupled with the detonation port. The reactive panel includes an inner panel, an outer panel, and an explosive sheet disposed between the inner panel and the outer panel and operatively associated with a venting device. A system for venting a container includes a venting device and an initiator coupled with the venting device. The initiator includes a detonation port and a reactive panel coupled with the detonation port. The reactive panel includes an inner panel, an outer panel, and an explosive sheet disposed between the inner panel and the outer panel and operatively associated with the venting device. A method of venting a container includes providing a venting system operatively associated with a container, detonating an explosive sheet of the venting system, and venting the container as a result of detonating the explosive sheet.

16 Claims, 5 Drawing Sheets

IMPACT INITIATED VENTING SYSTEM AND METHOD OF USING SAME

BACKGROUND

1. Field of the Invention

This invention relates to a method and apparatus for venting containers housing energetic materials. In particular, the invention relates to an impact initiated venting system and a method of using same.

2. Description of Related Art

Energetic materials, such as explosives and propellants, are often found in confined spaces within munitions. Under normal conditions, these materials are unlikely to explode or burn spontaneously; however, many are sensitive to heat and mechanical shock. For example, when exposed to extreme heat (as from a fire) or when impacted by bullets or fragments from other munitions, the energetic materials may be initiated, causing the munitions in which they are disposed to inadvertently explode prematurely.

Efforts have been made to develop "insensitive munitions," which are munitions that are generally less likely to detonate except in their intended missions to destroy targets. It is less likely that such an insensitive munition will detonate if a bullet or a fragment from an explosion strikes it. Moreover, it is less likely that such an insensitive munition will detonate if it is in close proximity to a target that is hit. Similarly, if the insensitive munition is exposed to extreme temperatures, as from a fire, the insensitive munition will likely only burn, rather than explode.

One way that munitions have been made more insensitive is by developing new explosives and propellants that are less likely to be initiated by heating and/or inadvertent impact. Such materials, however, are typically less energetic and, thus, may be less capable of performing their intended task. For example, a less energetic explosive may be less capable of destroying a desired target than a more energetic explosive. As another example, a less energetic propellant may produce less thrust than a more energetic propellant, thus reducing the speed and/or the range of the munition. Additionally, the cost to verify and/or qualify new explosives and/or propellants, from inception through arena and system-level testing, can be substantial when compared to improving the insensitive munition compliance of existing explosives and/or propellants.

Another system has been developed that selectively vents a container in which an energetic material is disposed, such as a munition, at a predetermined temperature or within a predetermined range of temperatures. In one particular embodiment, a pyrotechnic train is initiated at a particular temperature or within a particular range of temperatures that, in turn, detonates a cutting charge, such as a linear shaped charge. The explosive products from the cutting charge are used to cut the container, thus releasing pressure therein or preventing the buildup of pressure therein. The impact of a bullet, fragment, or shaped charge jet with the container proximate the venting system may result in a temperature sufficient to initiate the venting system. Additional safeguards, however, may be desirable to ensure such a venting system is initiated in the event of an impact to the container.

While there are many ways known in the art to render munitions more insensitive, considerable room for improvement remains. The present invention is directed to overcoming, or at least reducing, the effects of one or more of the problems set forth above.

SUMMARY OF THE INVENTION

In one aspect of the present invention, an initiator is provided, operatively associated with a venting device. The initiator includes a detonation port and a reactive panel coupled with the detonation port. The reactive panel includes an inner panel, an outer panel, and an explosive sheet disposed between the inner panel and the outer panel and operatively associated with the venting device.

In another aspect of the present invention, a system for venting a container is provided. The system includes a venting device and an initiator coupled with the venting device. The initiator includes a detonation port and a reactive panel coupled with the detonation port. The reactive panel includes an inner panel, an outer panel, and an explosive sheet disposed between the inner panel and the outer panel and operatively associated with the venting device.

In yet another aspect of the present invention, a method of venting a container is provided. The method includes providing a venting system operatively associated with a container, detonating an explosive sheet of the venting system, and venting the container as a result of detonating the explosive sheet.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
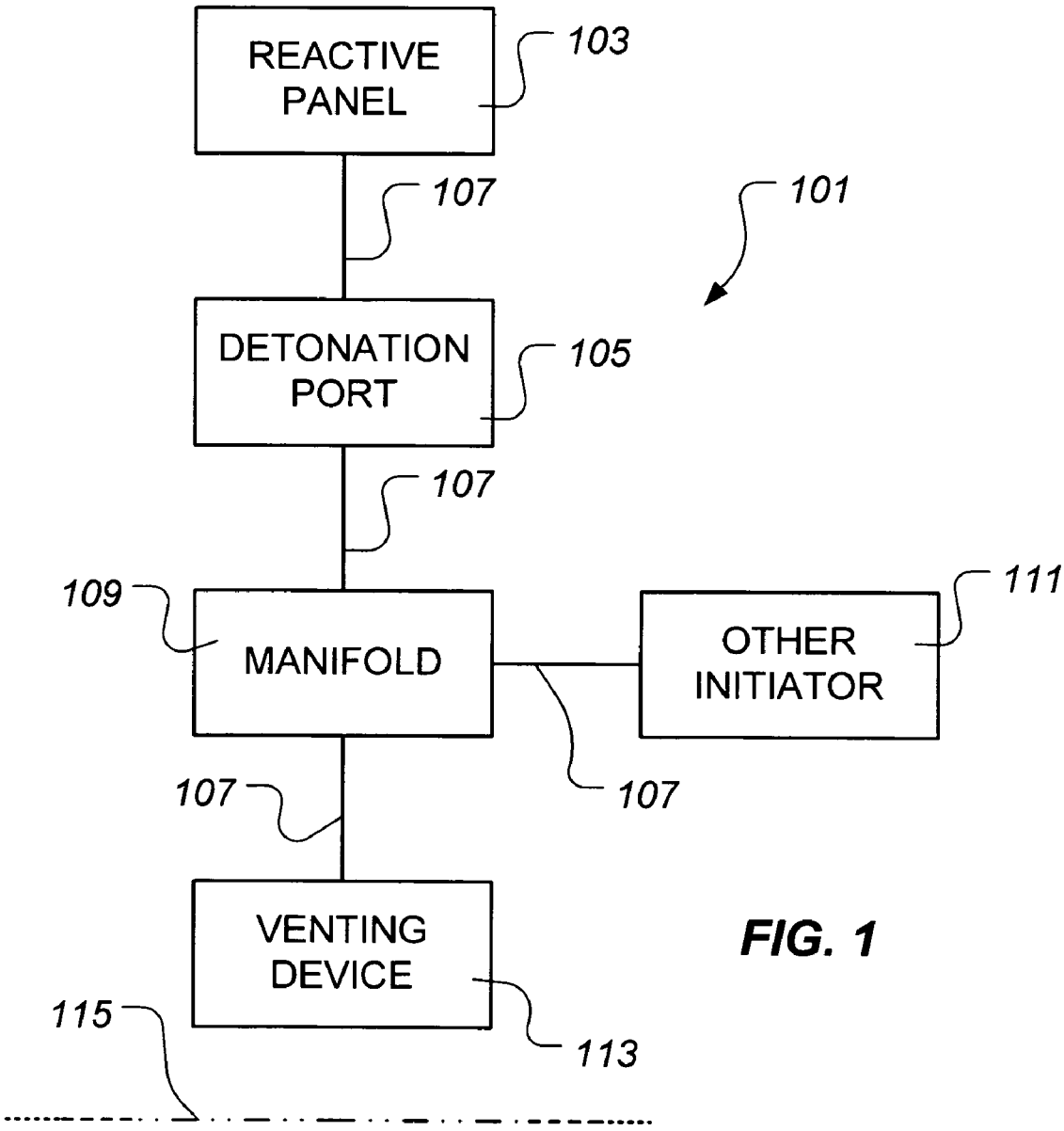
FIG. 1 is a block diagram representing a venting system according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to an apparatus for selectively venting a container in which an energetic material is disposed when a reactive panel of the apparatus is impacted by an object with energy sufficient to initiate the reactive panel. Examples of such an object, while neither exhaustive nor exclusive, include a bullet, a fragment, a shaped charge jet, or the like. For the purpose of this disclosure, an energetic material is defined as a material that, when subjected to a given amount of stimulating energy, reacts by producing a great deal more energy. Such materials, when confined within a container, may explode when impacted. Examples of such energetic materials are propellants, explosives, pyrotechnic materials, and detonation initiation substances, although this list is neither exclusive nor exhaustive. The present invention seeks to inhibit inadvertent detonation or deflagration of confined energetic material resulting from an impact by venting the container in which the energetic material is contained.

FIG. 1 provides a schematic representation of various aspects of the present invention. A venting system 101 comprises an initiator including a reactive panel 103 coupled with a detonation port 105. Reactive panel 103 may be coupled with detonation port 105 by a transfer line 107 or detonation port 105 may be disposed proximate or adjacent reactive panel 103. Detonation port 105 is coupled to a manifold 109 via transfer line 107. In some embodiments, one or more other initiators 111 may each be coupled with manifold 109 by, for example, transfer line 107. Such other initiators 111 may be adapted to provide an energetic stimulus to manifold 109 based upon temperature, impact, or the like. Manifold 109 is coupled via transfer line 107 with a venting device 113 for venting a container 115 (shown in phantom). Generally, manifold 109 assimilates multiple inputs (e.g., from detonation port 105 or other initiators 111) into one or more outputs (e.g., to venting device 113). Moreover, manifold 109 may, in certain embodiments, amplify the inputs being assimilated and transmitted therethrough.

As discussed above, various components of venting system 101 are interconnected by transfer lines 107. In one particular embodiment, transfer lines 107 comprise shielded mild detonating cord. Other constructions of transfer lines 107, however, are within the scope and content of the present invention. Further, the present invention may provide only one manifold 109 to which all reactive panels 103 are coupled. In other embodiments, however, a plurality of manifolds 109 may be employed, such that some reactive panels 103 are coupled with one of the manifolds 109 while other reactive panels 103 are coupled with another of manifolds 109. In such embodiments, manifolds 109 may be coupled with venting device 113 via one or more other manifolds 109 or other such manifolds.

Many devices and systems incorporate energetic materials. Examples of such devices include, but are not limited to, munitions (e.g., missiles, rockets, bombs, and ballistic rounds), oilfield explosives (e.g., downhole perforating charges), airbags (e.g., automobile airbags), and containerized liquid or gelled explosives (e.g., those used in underground and underwater mining and/or demolition). The present invention is described below in conjunction with a munition; however, it is not so limited. Rather, the scope of the present invention encompasses its use in conjunction with various devices and systems that incorporate energetic material, such as those listed above. Note that this list is exemplary, and is neither exhaustive nor exclusive.

Figure 2:
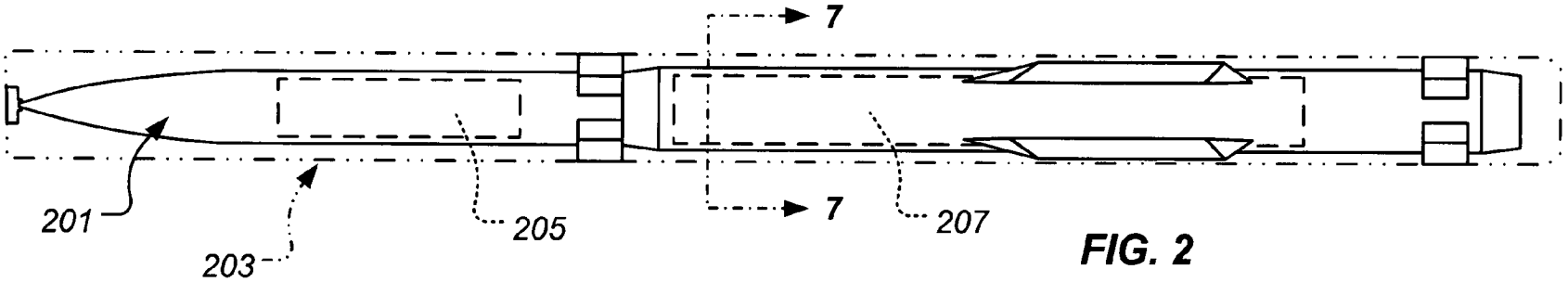
FIG. 2 is a stylized, elevational view of an exemplary munition disposed in an exemplary canister, the canister being shown in phantom, all according to the present invention.

FIG. 2 provides a stylized elevational view of a munition 201 contained within a canister 203 (shown in phantom). In this embodiment, canister 203 corresponds to container 115 (shown in FIG. 1). Such canisters 203 may be used, for example, to protect munition 201 during shipment or to house munition 201 prior to launch. Disposed within illustrated munition 201 are energetic materials, specifically an explosive 205 and a propellant 207. The shapes, forms, and locations of energetic materials 205, 207 illustrated in FIG. 2 are merely exemplary. Energetic materials 205, 207 may take on any number of shapes or forms and be disposed at various locations within munition 201, depending upon the design of munition 201.

As described in more detail below, the present invention selectively vents at least a portion of munition 201 proximate explosive 205 and/or propellant 207 when reactive panel 103 of the present invention is impacted with sufficient energy by an object to initiate reactive panel 103. In this embodiment, munition 201 corresponds to container 115 of FIG. 1 and reactive panel 103 is operatively associated with canister 203. The venting opens the interior of munition 201 to the atmosphere to relieve pressure therein and, thus, inhibit inadvertent detonation of explosive 205 and/or propellant 207.

For the purposes of this disclosure, the term "deflagration" means "an explosive reaction in which the reaction rate is less than the speed of sound in the reacting material." Deflagration differs from "burning" in that, during deflagration, the reacting material itself supplies oxygen required for the reaction. In burning, oxygen is provided from another source, such as from the atmosphere. Further, the term "detonation" means "an explosive reaction in which the reaction rate is greater than the speed of sound in the reacting material."

Figure 3:
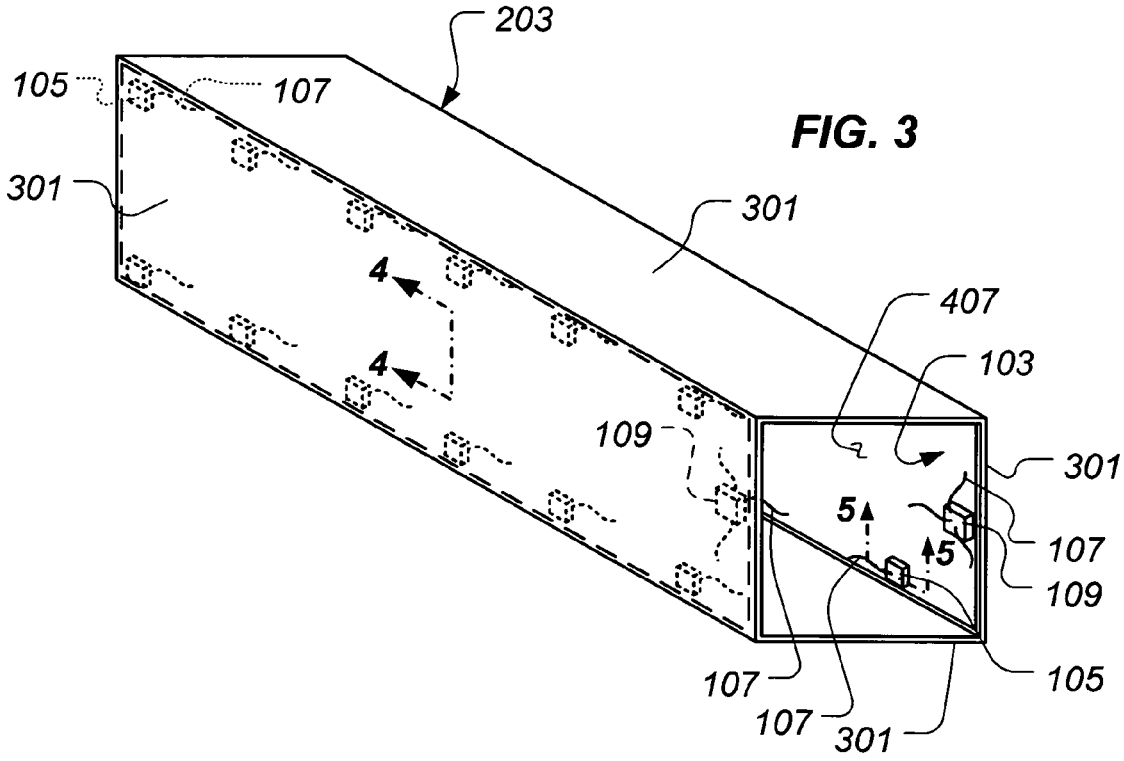
FIG. 3 is a stylized, perspective view of a first illustrative embodiment of certain components of a venting system operatively associated with a canister, all according to the present invention.

FIG. 3 provides a perspective view of a first embodiment of the present invention in conjunction with canister 203. In the illustrated embodiment, reactive panel 103 is affixed to an interior surface 401 (shown in FIG. 4) of canister 203 and one or more detonation ports 105 are affixed to reactive panel 103. Thus, in this embodiment, transfer lines 107 extending between reactive panel 103 and detonation ports 105 are omitted. Detonation ports 105 are connected by transfer lines 107 to manifold 109, which, in turn, is connected to venting device (not shown in FIG. 2) via transfer line 107. Note that manifold 109 may be adapted to receive inputs from one or more other initiators 111, as discussed above concerning FIG. 1.

Still referring to FIG. 3, reactive panel 103 is adapted to initiate (e.g., detonate, deflagrate, burn, etc.) upon impact from a projectile, such as a bullet, fragment, or the like. Energy produced by initiated reactive panel 103 is transmitted to detonation ports 105, wherein the energy is amplified and transmitted to manifold 109. Manifold 109 transmits received energy to venting device 113 (not shown in FIG. 2). Venting device 113, in turn, vents the container housing the energetic material, which, in the illustrated embodiment, is munition 201.

Figure 4:
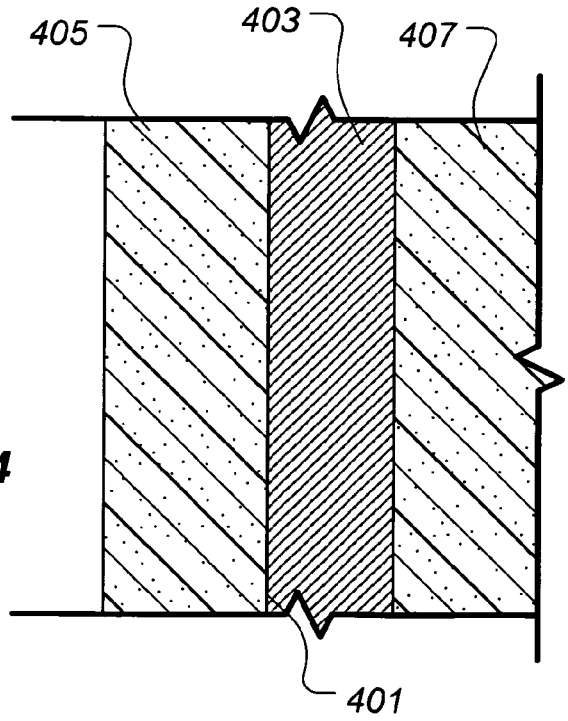
FIG. 4 is a stylized, cross-sectional view of a portion of a reactive panel of the embodiment shown in FIG. 3, taken along the line 4-4 in FIG. 3.

FIG. 4 depicts one particular configuration of reactive panel 103 of FIG. 1 and its relationship to canister 203 in the embodiment of FIG. 3. Reactive panel 103 comprises an explosive sheet 403 disposed between an outer panel 405 and an inner panel 407. In some embodiments, inner panel 407 may be omitted. In the illustrated embodiment, outer panel 405 comprises a wall 301 (shown in FIG. 3) of canister 203. Other constructions, however, are possible and are within the scope of the present invention, as will be discussed in greater detail below. The composition of explosive sheet 403 is highly implementation specific. For example, the material comprising explosive sheet 403 may be selected based upon its impact sensitivity. If it is desired for explosive sheet 403 to detonate only upon relatively high-energy impacts, a lower impact sensitivity explosive may be selected. This configuration may lessen the likelihood that explosive sheet 403 will detonate during routine handling. However, if it is desired for explosive sheet 403 to detonate when subjected to lower energy impacts, a higher impact sensitivity explosive material may be selected. Examples of explosive materials suitable for explosive sheet 403 in certain implementations include, but are not limited to, cyclotrimethylenetrinitramine (RDX), cyclotetramethylenetetranitramine (HMX), trinitrotoluene (TNT), pentaerythrite tetranitrate (PETN), or the like. Commercially available explosive sheet materials, such as EL506 Detasheet, provided by E. I. DuPont de Nemours, may also be suitable for explosive sheet 403.

With relation to the present invention, outer panel 405 and inner panel 407 serve to contain explosive sheet 403. The particular composition of panels 405, 407 are not pertinent to the present invention, as long as explosive sheet 407 can be detonated with the desired impact energy. In some embodiments, panels 405, 407 may comprise, for example, aluminum, an aluminum alloy, steel, a carbon- or graphite-reinforced polymer, a glass fiber-reinforced polymer, an aramid fiber-reinforced polymer, or the like.

Figure 5:
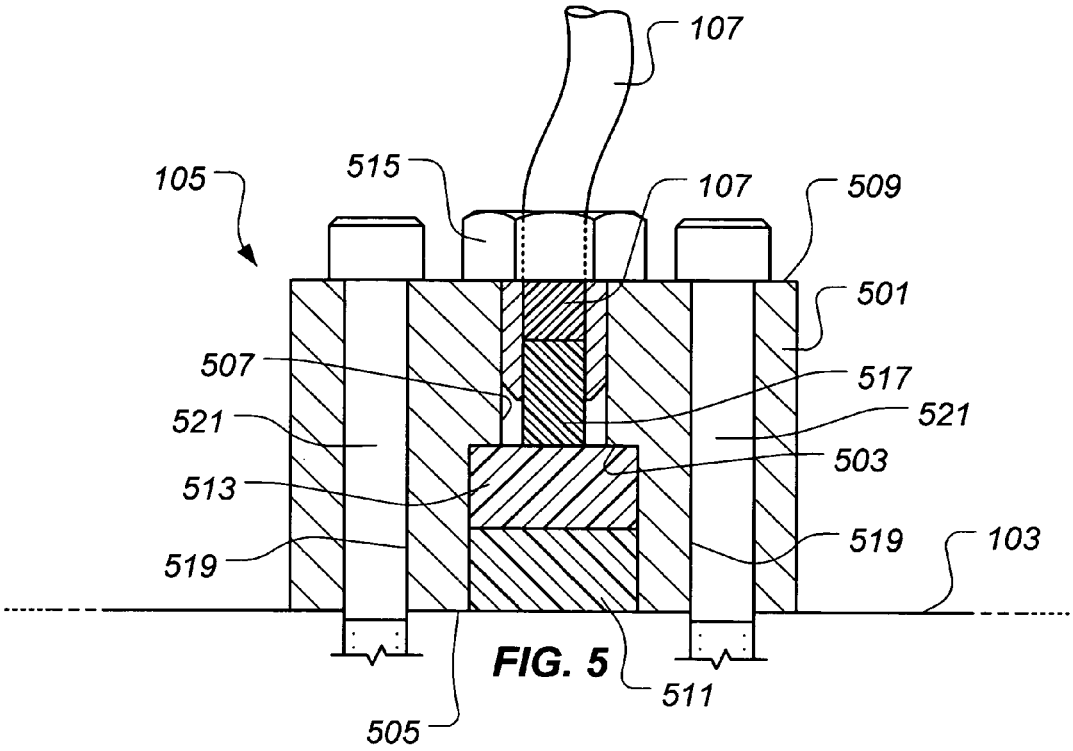
FIG. 5 is a stylized, cross-sectional view of a detonation port of the embodiment shown in FIG. 3, taken along the line 5-5 in FIG. 3.

FIG. 5 depicts, in cross-section, one particular illustrative embodiment of detonation port 105 of FIG. 1. Note that FIG. 5 provides a cross-sectional view of detonation port 105 taken along the line 5-5 in FIG. 3. In the illustrated embodiment, detonation port 105 comprises a housing 501 defining a cavity 503 extending from a lower surface 505 of housing 501 and a passage 507 leading from cavity 503 through an upper surface 509 of housing 501. A first booster 511 is disposed in cavity 503 adjacent or in contact with reactive panel 103. A second booster 513 is disposed in cavity 503 adjacent or in contact with first booster 511. Detonation port 105 further comprises a fitting 515 engaged with housing 501 adapted to retain transfer line 107 in place. While fitting 515 may be retained in housing 501 by a variety of means, fitting 515 is threadedly engaged with housing 501 in one particular embodiment.

Still referring to FIG. 5, detonation port 105 further comprises a third booster 517 disposed adjacent or in contact with second booster 513. Third booster 517 is disposed in fitting 515 such that transfer line 107 may be placed adjacent or in contact with third booster 517. Note that transfer line 107 may comprise shielded mild detonating cord or the like. Boosters 511, 513, 517 may comprise materials such as CH-6 explosive or other high explosives. Generally, first booster 511 comprises a material that is more energetic than the material of reactive panel 103. Second booster 513 comprises a material that is more energetic than the material of first booster 511. Third booster 517 comprises a material that is more energetic than the material of second booster 513. In embodiments wherein boosters 511, 513 comprise the same material, the material of second booster 513 may be more firmly packed than that of first booster 511 and, thus, have a higher density, than that of first booster 511. In embodiments wherein boosters 513, 517 comprise the same material, the material of third booster 517 may be more firmly packed than that of booster 513.

Housing 501 further defines attachment passages 519 adapted to receive fasteners 521 for attaching detonation port 105 to reactive panel 103. Note that the particular construction of detonation port 105 shown in FIG. 5 is merely one of many different constructions encompassed by the present invention. For example, detonation port 105 may be coupled with or attached to reactive panel 103 by another means, such that housing 501 omits attachment passages 519. Moreover, detonation port 105 may comprise one or more boosters (e.g., boosters 511, 513, 517) or, in some embodiments, detonation port 105 may be adapted to retain transfer line 107 adjacent or in contact with reactive panel 103. In some alternative embodiments, detonation port 105 may be adapted to directly couple transfer line 107 to reactive panel 103, omitting housing 501.

Figure 6:
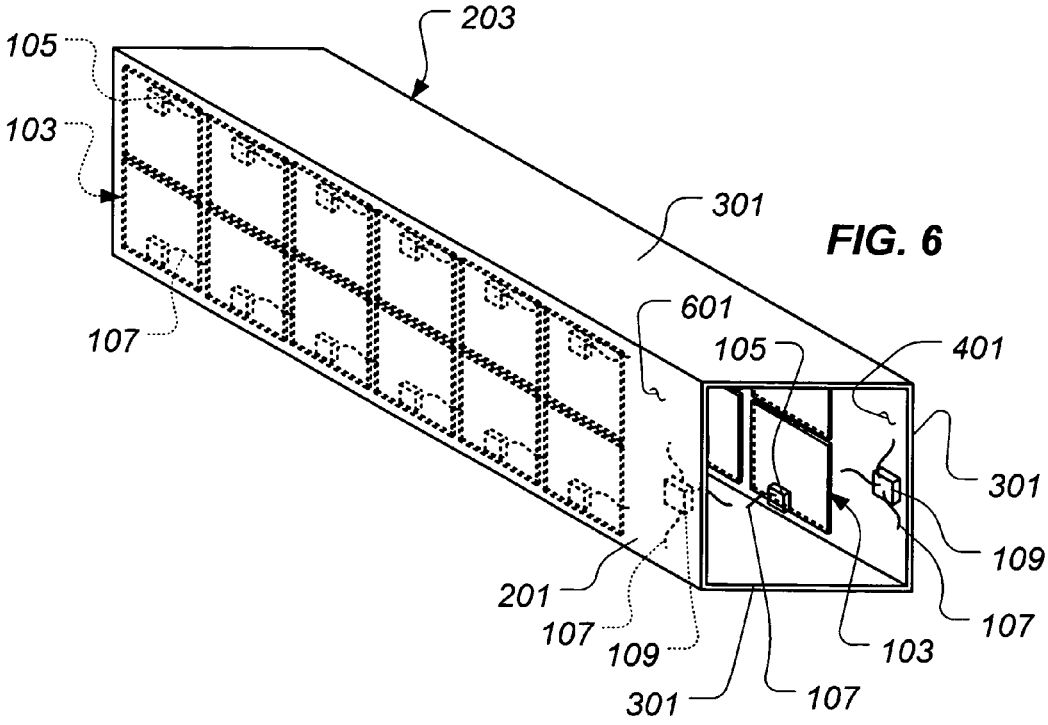
FIG. 6 is a stylized, perspective view of a second illustrative embodiment of certain components of a venting system operatively associated with a canister, all according to the present invention.

FIG. 6 depicts a second illustrative embodiment of canister 203, in which reactive panels 103 are affixed to interior surface 401 of canister 203. In the illustrated embodiment, reactive panels 103 have a construction corresponding to that shown in FIG. 4. Reactive panels 103 may be attached to interior surface 401 by any suitable means. Note that the particular pattern of reactive panels 103 on interior surface 401 depicted in FIG. 6 is merely exemplary. Depending upon the implementation, reactive panels 103 may be provided to completely cover interior surface 401 or only a portion of interior surface 401. Further, reactive panels 103 may be disposed on interior surface 401 only in areas proximate energetic materials 205, 207. Moreover, reactive panels 103 may be disposed on outer surface 601 of canister 203. In various embodiments of the present invention, e.g., the embodiments of FIGS. 3 and 6, reactive panel 103 is operatively associated with canister 203.

Figure 7:
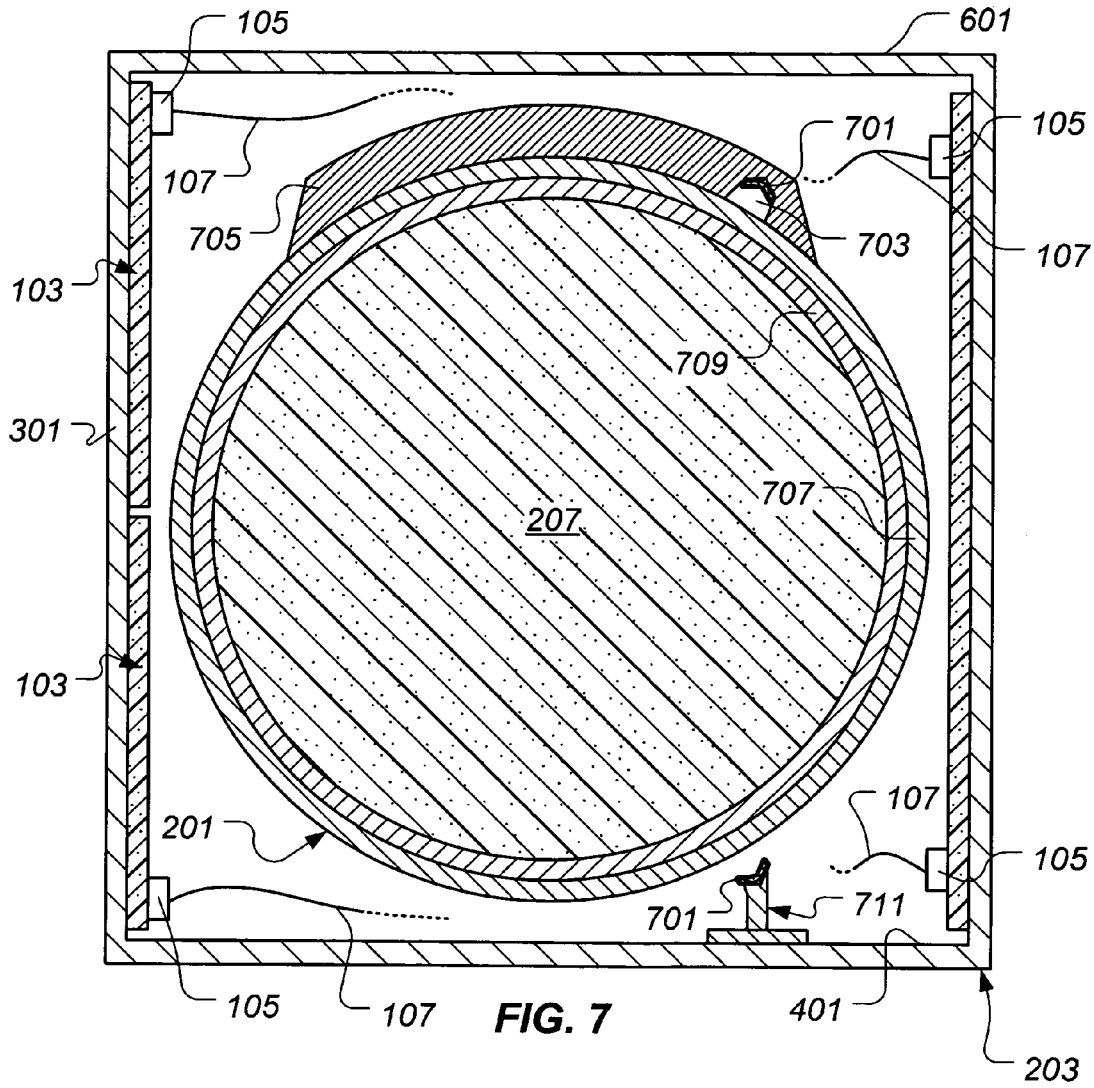
FIG. 7 is a stylized, cross-sectional view of the munition and the canister of FIG. 2 taken along the line 7-7 of FIG. 2.

FIG. 7 depicts, in cross-section, one particular embodiment of the munition 201 and the canister 203 of FIG. 2. While reactive panels 103 are shown disposed on inside surface 401 of canister 203 in FIG. 7, reactive panels 103 may, for example, be disposed on outer surface 601, or incorporated into canister 203, as discussed above concerning FIGS. 3, 4, and 6. In the illustrated embodiment, a linear shaped charge 701, which in this embodiment corresponds to venting device 113, is disposed in a cavity 703 defined by a wireway 705 of munition 201. As used herein, the term "linear shaped charge" includes linear shaped charges that have straight or curved forms and may be flexible or rigid. In this embodiment, linear shaped charge 701, which is a venting device, is operatively associated with munition 201. Munition 201 comprises propellant 207 disposed within a case 707. In this particular embodiment, an insulating layer 709 is disposed between propellant 207 and case 707. Note that propellant 207 may comprise any energetic material.

Linear shaped charge 701 may, alternatively, be attached to canister 203 instead of or in addition to being disposed in or on munition 201. In this particular embodiment, also shown in FIG. 7, linear shaped charge 701 is disposed in or on a bracket 711 extending from interior surface 401 of canister 203. Linear shaped charge 701, which is a venting device, is operatively associated with canister 203. In either case, reactive panels 103 are energetically coupled with one or more linear shaped charges 701 such that, when reactive panels 103 are initiated, one or more linear shaped charges 701 are activated to vent case 707. Note that linear shaped charge 701 is but one exemplary means for venting case 707. Other means for venting case 707, capable of being activated by reactive panel 103, are within the scope of the present invention.

Figure 8:
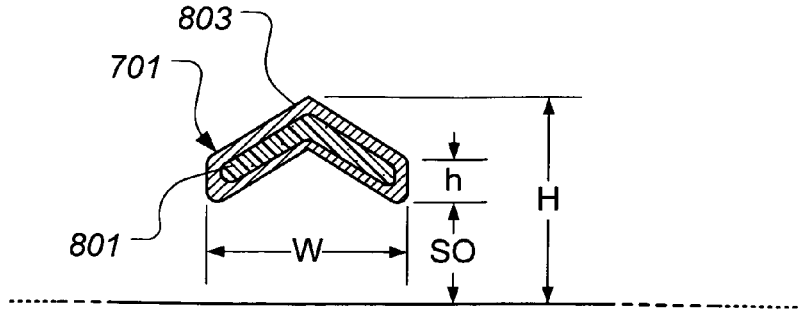
FIG. 8 is a stylized cross-sectional view of an illustrative embodiment of a linear shaped charge according to the present invention.

FIG. 8 depicts one illustrative embodiment of linear shaped charge 701 according to the present invention. In this embodiment, linear shaped charge 701 comprises an explosive 801, such as a PBXN5 explosive, enveloped by a sheath 803. Sheath 803 may comprise copper, a copper alloy, or other material suitable for linear shaped charge 701.

In one particular embodiment, the "coreload" of explosive 801 is about 15 grains per foot. The "coreload" is the explosive core of linear shaped charge 701, expressed as the weight in grains of explosive per foot. In other embodiments, however, the coreload may be within a range of about 10 grains per foot to about 50 grains per foot. The scope of the present invention, however, encompasses any suitable coreload, as it is highly dependent upon the particular implementation. Other explosive materials and sheaths, however, may be used and are encompassed by the present invention. Linear shaped charge 701 is disposed such that, when detonated, the jet formed by detonated charge 701 may travel substantially unimpeded to case 707.

Referring in particular to the embodiment of FIG. 7, for a thickness of case 707 within a range from about 0.14 inches to about 0.23 inches, the overall height H of linear shaped charge 701 is about 0.16 inches and its width W is about 0.22 inches. In this example, the leg height h of the linear shaped charge 701 is about 0.06 inches. The standoff SO from linear shaped charge 701 to case 707 is about 0.18 inches. The present invention, however, is not limited to this configuration. Rather, the particular dimensions of linear shaped charge 701 and the standoff SO between the linear shaped charge 701 and case 707 will be determined based upon at least the particular explosive 801, material of sheath 803, material of case 707, and the thickness of case 707, as will be appreciated by one of ordinary skill in the art having the benefit of this disclosure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An initiator operatively associated with a venting device, the initiator comprising:
- a detonation port; and
- a reactive panel coupled with the detonation port, the reactive panel, comprising:
  - an inner panel;
  - an outer panel; and
  - an explosive sheet disposed between the inner panel and the outer panel and operatively associated with the venting device.

2. The initiator according to claim 1, wherein the explosive sheet comprises at least one of cyclotrimethylenetrinitramine, cyclotetramethylenetetranitramine, trinitrotoluene, and pentaerythrite tetranitrate.

3. The initiator according to claim 1, wherein the detonation port comprises:
- a housing; and
- a booster disposed in the housing, the booster being located proximate the reactive panel.

4. The initiator according to claim 1, further comprising:
- a transfer line extending from the detonation port.

5. A system for venting a container, comprising:
- a venting device; and
- an initiator coupled with the venting device, the initiator comprising:
  - a detonation port; and
  - a reactive panel coupled with the detonation port, the reactive panel, comprising:
    - an inner panel;
    - an outer panel; and
    - an explosive sheet disposed between the inner panel and the outer panel and operatively associated with the venting device.

6. The system according to claim 5, wherein the explosive sheet comprises at least one of cyclotrimethylenetrinitramine, cyclotetramethylenetetranitramine, trinitrotoluene, and pentaerythrite tetranitrate.

7. The system according to claim 5, wherein the detonation port comprises:
- a housing; and
- a booster disposed in the housing, the booster being located proximate the reactive panel.

8. The system according to claim 5, wherein the venting device comprises:
- a linear shaped charge.

9. The system according to claim 5, further comprising:
- a transfer line coupling the detonation port and the venting device.

10. The system according to claim 9, wherein the transfer line comprises:
- shielded mild detonating cord.

11. The system according to claim 5, wherein the initiator is adapted to be operatively associated with a canister for housing a munition, such that the venting system is adapted to vent the munition.

12. The system according to claim 11, wherein the venting device is adapted to be disposed on or in the munition.

13. The system according to claim 11, wherein the venting device is operatively associated with the canister.

14. The system according to claim 5, further comprising a manifold, coupled between the detonation port and the venting device.

15. The system according to claim 14, further comprising a first transfer line and a second transfer line, such that the first transfer line couples the manifold with the detonation port and the second transfer line couples the manifold and the venting device.

16. The system, according to claim 14, wherein at least one of the transfer line and the second transfer line comprises:
- shielded mild detonating cord.

* * * * *